US006981591B2

(12) United States Patent
Logan

(10) Patent No.: US 6,981,591 B2
(45) Date of Patent: Jan. 3, 2006

(54) CASE WITH ELASTIC-SECURED END CAP

(75) Inventor: Andrew J. Logan, Newbury Park, CA (US)

(73) Assignee: Umbra Inc., Buffalo, NY (US)

( * ) Notice: Subject to any disclaimer, the term of this patent is extended or adjusted under 35 U.S.C. 154(b) by 63 days.

(21) Appl. No.: 10/604,580

(22) Filed: Jul. 31, 2003

(65) Prior Publication Data

US 2005/0023157 A1 Feb. 3, 2005

(51) Int. Cl.
*B65D 85/30* (2006.01)
*B65D 45/00* (2006.01)

(52) U.S. Cl. ..... 206/451; 206/37; 206/38; 206/805; 220/315; 220/375

(58) Field of Classification Search ..... 206/37, 206/38–38.1, 805, 449–451; 220/315, 375
See application file for complete search history.

(56) References Cited

U.S. PATENT DOCUMENTS

| | | | | | |
|---|---|---|---|---|---|
| 356,524 | A | | 1/1887 | Clement | |
| 1,094,283 | A | | 4/1914 | Wick | |
| 1,219,029 | A | | 3/1917 | Myers et al. | |
| 1,525,745 | A | * | 2/1925 | Keefer | 206/805 |
| 1,714,688 | A | * | 5/1929 | Mikkelsen | 206/449 |
| 1,842,034 | A | * | 1/1932 | Lewis | 206/805 |
| 2,007,740 | A | * | 7/1935 | Brelsford | 206/805 |
| 2,349,985 | A | | 5/1944 | Page | |
| 2,531,737 | A | | 11/1950 | Lyon, Jr. | |
| 2,737,312 | A | | 6/1956 | Hamlon | |
| 3,421,839 | A | | 1/1969 | Ward | |
| 3,688,896 | A | | 9/1972 | Newell | |
| 3,970,129 | A | | 7/1976 | Tepfer | |
| 4,792,058 | A | | 12/1988 | Parker | |
| 4,826,042 | A | * | 5/1989 | Vujovich | 221/228 |
| 4,850,512 | A | * | 7/1989 | Vujovich | 221/232 |
| 5,125,505 | A | | 6/1992 | Kurosaki | |
| D338,336 | S | | 8/1993 | Grant | |
| 5,531,966 | A | * | 7/1996 | Brouwer | 206/805 |

* cited by examiner

*Primary Examiner*—Bryon P. Gehman
(74) *Attorney, Agent, or Firm*—Simpson & Simpson, PLLC

(57) ABSTRACT

A case, including a housing having a hollow interior and a channel proximate a perimeter of the housing at two sides thereof, a first end cap fixedly secured to a first end of the housing, the first end cap having a channel proximate a perimeter thereof, a second end cap removably secured to a second end of the housing, the second end cap having a channel proximate a perimeter thereof, and an elastic band positioned within the channel of the housing, the channel of the first end cap and the channel of the second end cap, the elastic band operatively arranged to urge the second end cap into a retained position in engagement with the second end of the housing.

20 Claims, 13 Drawing Sheets

CASE WITH ELASTIC-SECURED END CAP

FIELD OF THE INVENTION

The present invention relates generally to cases for holding business cards, notes, notepads, credit cards, and the like, and, more particularly, to cases that include spring-loaded, or elastically secured lids or covers.

BACKGROUND OF THE INVENTION

A number of cardholder devices, cases, and related inventions are known in the art. Some of the known cases are configured to merely hold cards; others are designed to dispense cards. Some include hinged covers; others include spring-loaded covers. Examples of various types of cases disclosed in United States patents are as follows:

U.S. Pat. No. 5,125,505 (Kurosaki) discloses a cardholder for holding a card. The holder includes a couple of springs, against which a card to be held is placed. The springs function to dispense the card from the case.

U.S. Pat. No. 4,792,058 (Parker) discloses a dispenser for business or calling cards. This patented device includes a retracted ejector mechanism on the side of the case for dispensing the cards.

U.S. Pat. No. 3,970,129 (Tepfer) discloses a sales slip wallet. The drawing figures of this patent depict various embodiments of the wallet, all of which use elastic means to urge panels of the wallet into a closed position.

U.S. Pat. No. 3,688,896 (Newell) discloses a card case intended for carrying credit cards. The case includes a lid operatively arranged to be prevented from closing until all intended cards are replaced within the case.

U.S. Pat. No. 3,421,839 (Ward) discloses a container for air treating devices, which container includes two end caps, secured to one another by an elastic band to bias the two end caps toward one another, closing the container.

U.S. Pat. No. 2,737,312 (Hamlon) discloses a container having a lid, hinged to the container and biased toward a closed position by a rubber band secured to the bottom of the container.

U.S. Pat. No. 2,531,737 (Lyon, Jr.) discloses a container having a spring biased sliding closure.

U.S. Pat. No. 2,349,985 (Page) discloses a receptacle closure for a small container. The lid to the container is hinged, and an elastic band is secured to the underside of the lid and a sidewall of the container, arranged to urge closure of the lid onto the container.

U.S. Pat. No. 1,219,029 (Kell) discloses an early 20th century example of a spring closing receptacle.

U.S. Pat. No. 1,094,288 (Wick) discloses a matchbox having a spring-loaded cover.

U.S. Pat. No. 356,524 (Clement) is an 1887 patent that describes a cylindrically shaped holder for pens and pencils. The invention includes two balls, one at each end of the holder. The balls are connected to one another by an elastic band, urging them inwardly towards the body of the holder.

Finally, U.S. Design Pat. No. Des. 338,336(Grant) discloses a card case having a hinged top.

Despite the many examples of cases in the patent art, as yet no one has apparently invented or patented a case having the structure or function of the present invention.

SUMMARY OF THE INVENTION

The present invention broadly comprises a case, including a housing having a hollow interior and a channel proximate a perimeter of the housing at two sides thereof, a first end cap fixedly secured to a first end of the housing, the first end cap having a channel proximate a perimeter thereof, a second end cap removably secured to a second end of the housing, the second end cap having a channel proximate a perimeter thereof, and an elastic band positioned within the channel of the housing, the channel of the first end cap and the channel of the second end cap, the elastic band operatively arranged to urge the second end cap into a retained position in engagement with the second end of the housing.

A primary object of the invention is to provide a case for holding business cards and the like, which case, in a first embodiment, includes an end cap detachably secured to a housing of the case by an elastic band.

Another object of the invention is to provide a case for holding business cards and the like, which case, in a second embodiment, includes two end caps detachably secured to a housing of the case by an elastic band.

These and other objects, features and advantages of the invention will become readily apparent to one having ordinary skill in the art upon study of the following detailed description in view of the drawings and appended claims.

DETAILED DESCRIPTION OF THE PREFERRED EMBODIMENT

At the outset, it should be appreciated that like reference numbers on different drawing figures represent identical structural elements. It should also be appreciated that, while a number of different embodiments and variations of the present invention are shown in the various drawings, the invention as claimed is not intended to be limited to these specific embodiments, as the claims define a broader invention that can take many different shapes and structures. Also, the adjectives, "top", "bottom", "right", "left", and their derivatives, in the description herebelow, refer to the perspective of one facing the invention as shown in the figure under discussion. Finally, the present invention includes an elastic band or cord. In one embodiment, the band comprises a closed loop, preferably formed from a linear band whose terminal ends have been secured to one another; in another embodiment it comprises a single length of cord; and, in yet another embodiment it comprises two separate lengths of cord. In all embodiments, the cord is located proximate the perimeter of the case housing. In a preferred embodiment, the cord is not located in the hollow interior of the housing, so as not to interfere with the ability of the case to hold business cards and the like. It should also be appreciated that the case of the invention is designed to hold a variety of items, including, but not limited to, business cards, photographs, note pads, paper clips, computer and digital device memory cards, and a variety of other objects and articles.

Figure 1:
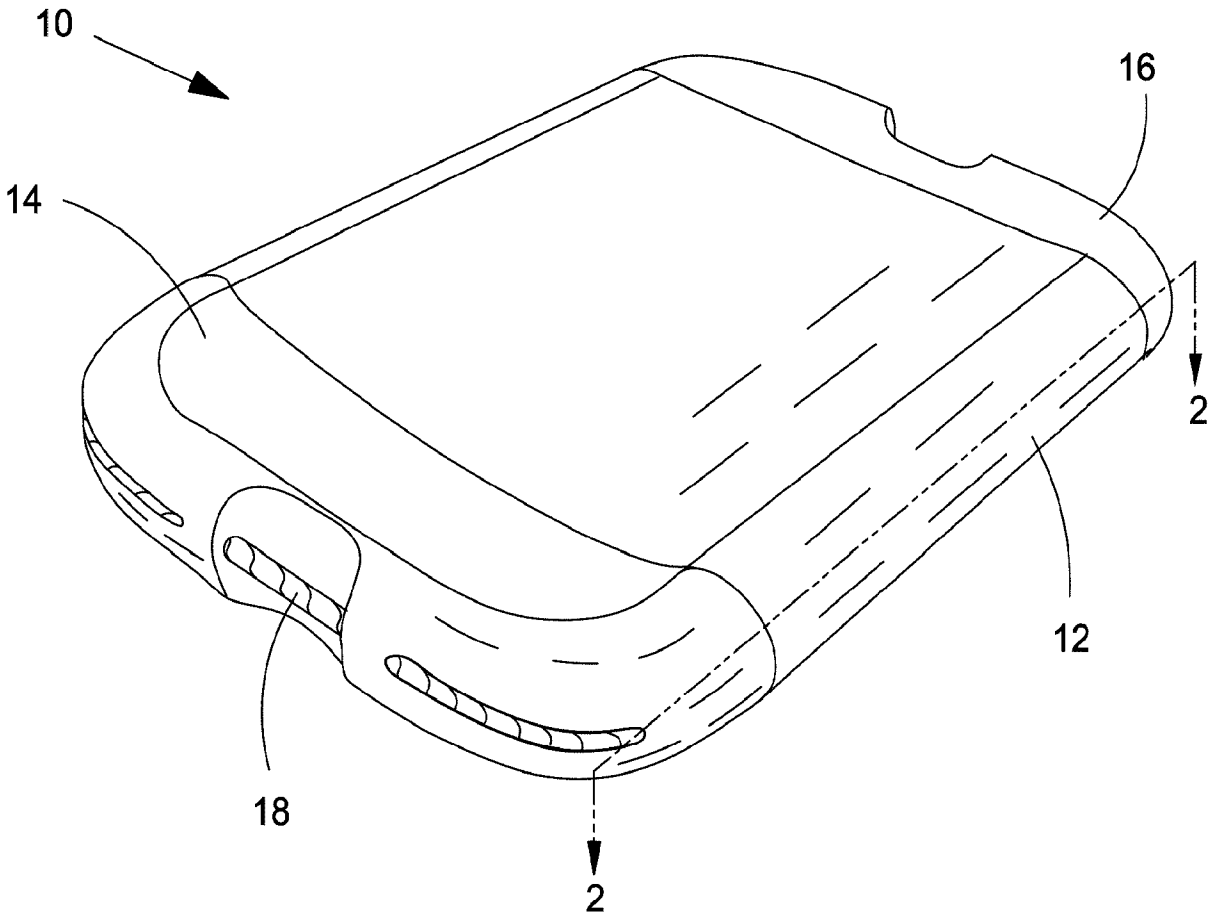
FIG. 1 is a perspective view of the case of the invention.

Adverting now to the drawings, FIG. 1 illustrates a first embodiment of case 10 of the invention. Case 10 is seen to comprise housing 12, first end cap 16, and second end cap 14. In a preferred embodiment, first end cap 16 is fixedly secured to the housing, whereas second end cap 14 is detachably secured to the housing. More particularly, elastic band 18 circumscribes a channel in the two end caps and in the housing, and is operatively arranged to urge second end cap 14 into a closed position as shown in FIG. 1. In the embodiment shown, end caps 14 and 16 are made of plastic, and housing 12 is made of aluminum, although the material of composition of the individual structural elements of the invention is not germane to the invention. The size and elasticity of band 18 is selected such that second end cap 14 may be pulled and removed a sufficient distance from the housing as to be able to insert and remove articles and objects into and out of the case, respectively.

Figure 2:
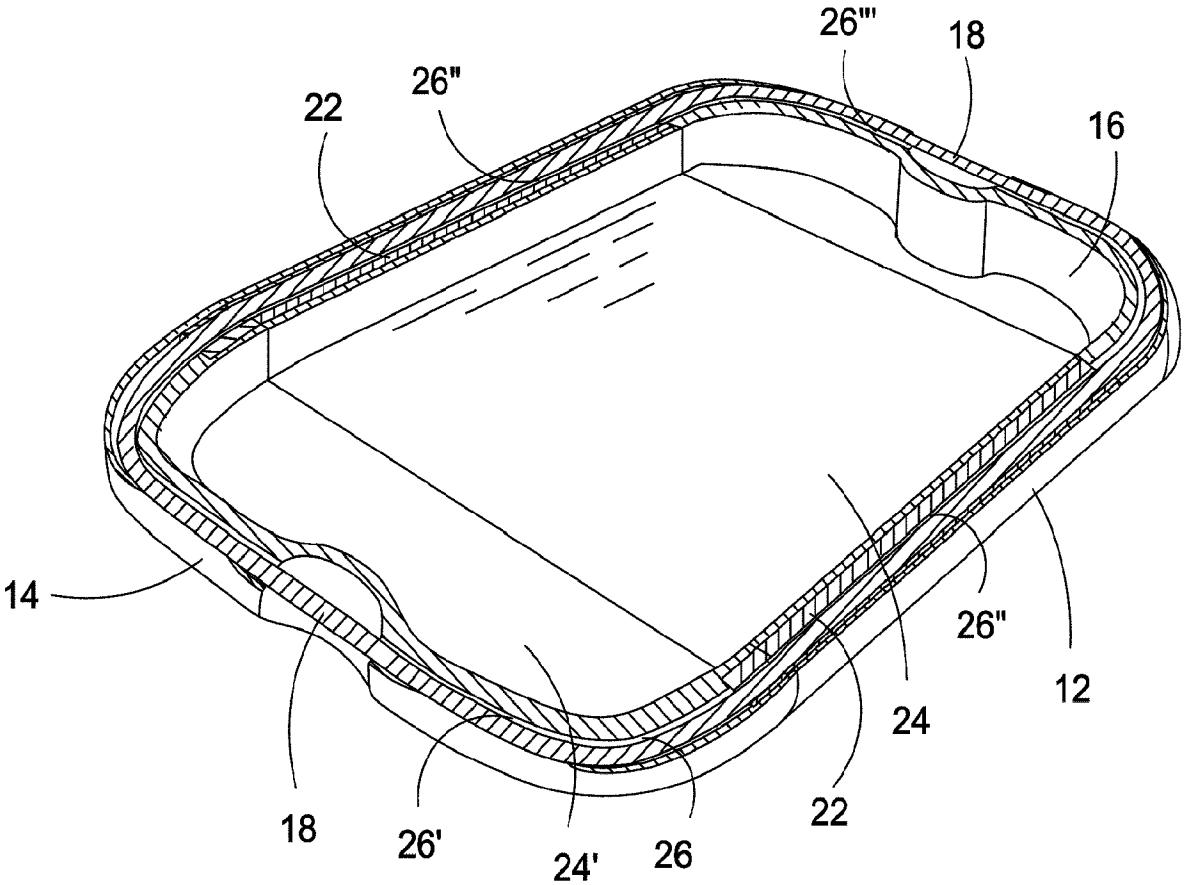
FIG. 2 is a cross-sectional view of the case shown in FIG. 1 taken generally along line 2—2 in FIG. 1.

FIG. 2 is a cross-sectional view of the case taken generally along line 2—2 of FIG. 1. This view illustrates how elastic cord 18 circumscribes the perimeter of the case. Cord 18 lies in a channel 26, which channel exists in second end cap as channel 26', first end cap 26''' and in alignment studs 22 as channel 26", as better shown in FIGS. 3, 3A and 4. The cord is located proximate the perimeter of the case, so as not to interfere with storage of articles in space 24 within the case.

Figure 3:
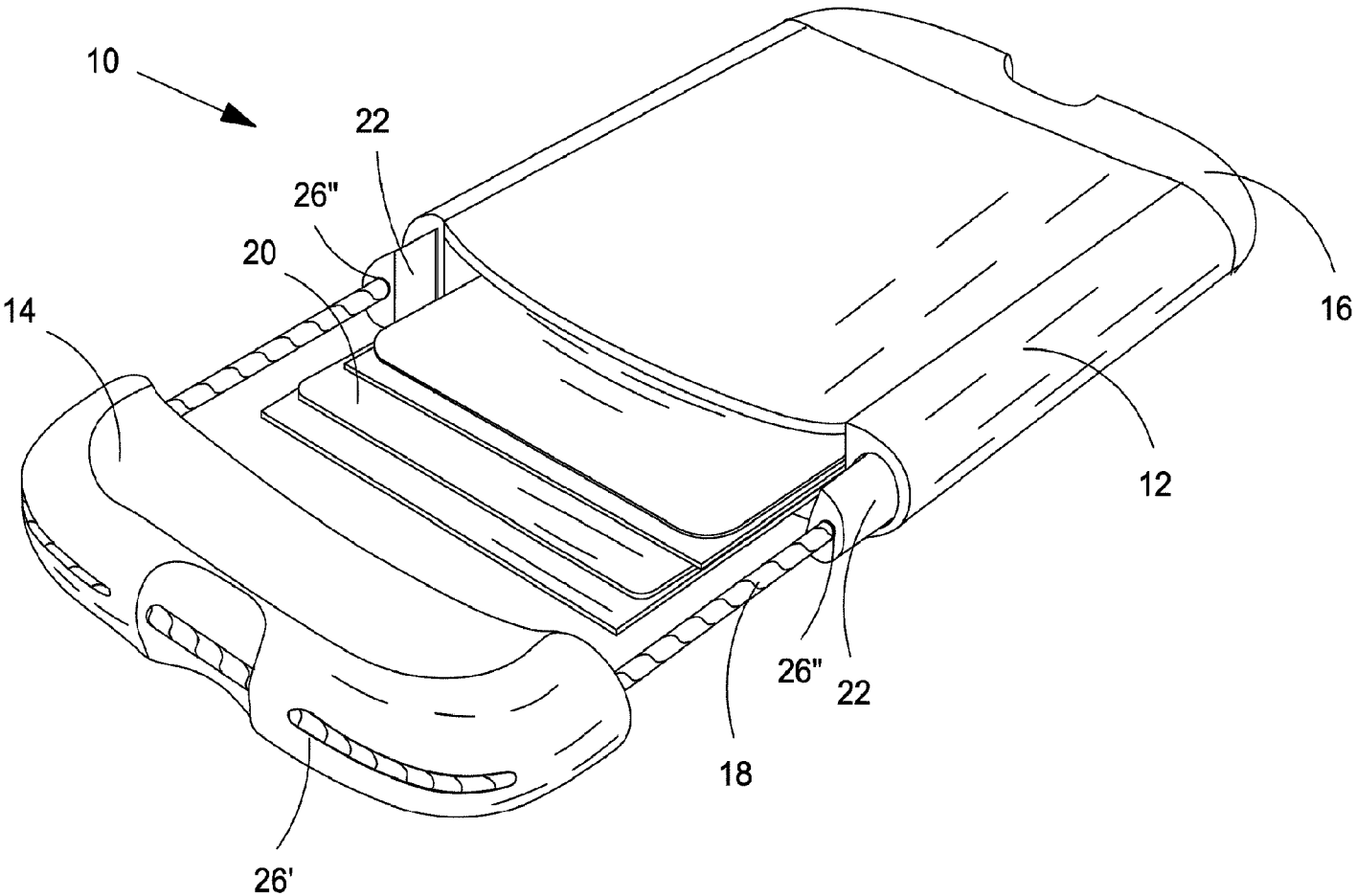
FIG. 3 is a perspective view of the case shown in FIG. 1, except with the case open to expose its contents.
Figure 3A:
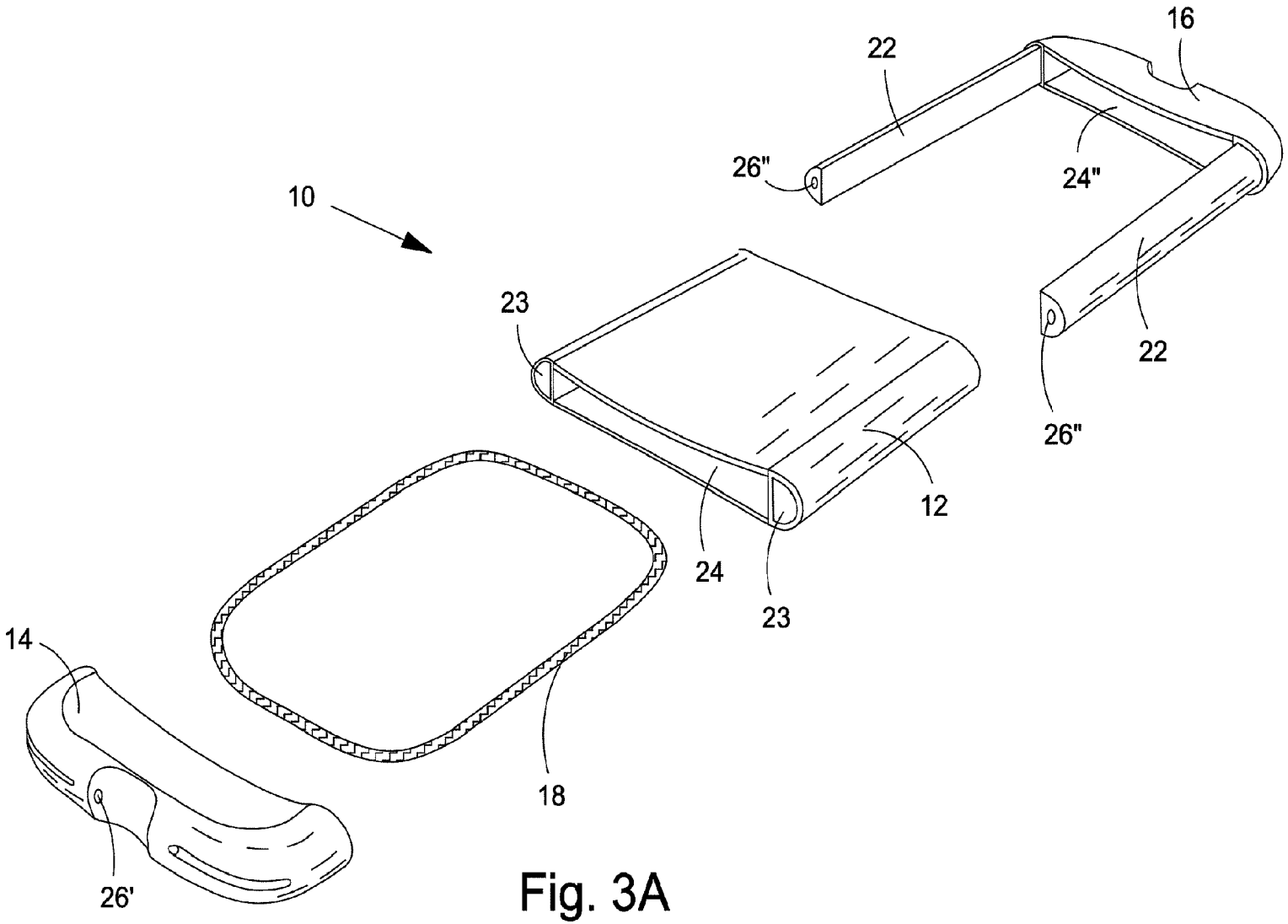
FIG. 3A is an exploded view of the case shown in FIG. 1.

Case 10 is shown in an open orientation in perspective view in FIG. 3. In this view, end cap 14 has been pulled leftwardly, against the bias of elastic cord 18, to expose inner space 24 (shown in FIG. 3A) of the case. Articles 20 are shown being held within the case. This view also shows alignment studs 22. The alignment studs function to align and hold end cap 14 in contact with housing 12. In a first embodiment, the two alignment studs are fixedly secured to end cap 16, and also secured within through-bores 23 of housing 12, as shown in FIG. 3A. Each alignment stud/finger includes a channel 26" for elastic cord 18. Thus it is seen that the studs, with their respective channels 26", function to form channel 26 within the perimeter of housing 12. As seen in FIG. 1, channel 26 is positioned both inside and partially outside the respective structural elements. For example, cord 18 is shown partially exposed with respect to end cap 14 in FIG. 1, partially inside and partially outside of channel 26'.

FIG. 3A is an exploded view of the case shown in FIGS. 1 and 3. This view shows that, in the first embodiment, cord 18 is formed in a closed loop, preferably formed by securing two terminal ends of a linear band to one another. This view also shows alignment studs 22 in more detail. The studs are shown to be semi-circular in cross-sectional shape, although this shape is not germane to the invention. The elongated studs are seen to be arranged to matingly engage through-bores 23 of housing 12. End cap 16 is seen to include inner space 24" which forms part of the interior of case 10. It should be appreciated by those having ordinary skill in the art that while a preferred embodiment comprises a pair of alignment studs operatively arranged for traversing the entire length of through-bores 23, four shortened studs, each secured within a terminal end of through-bores 23, could be provided to achieve similar results.

Figure 4:
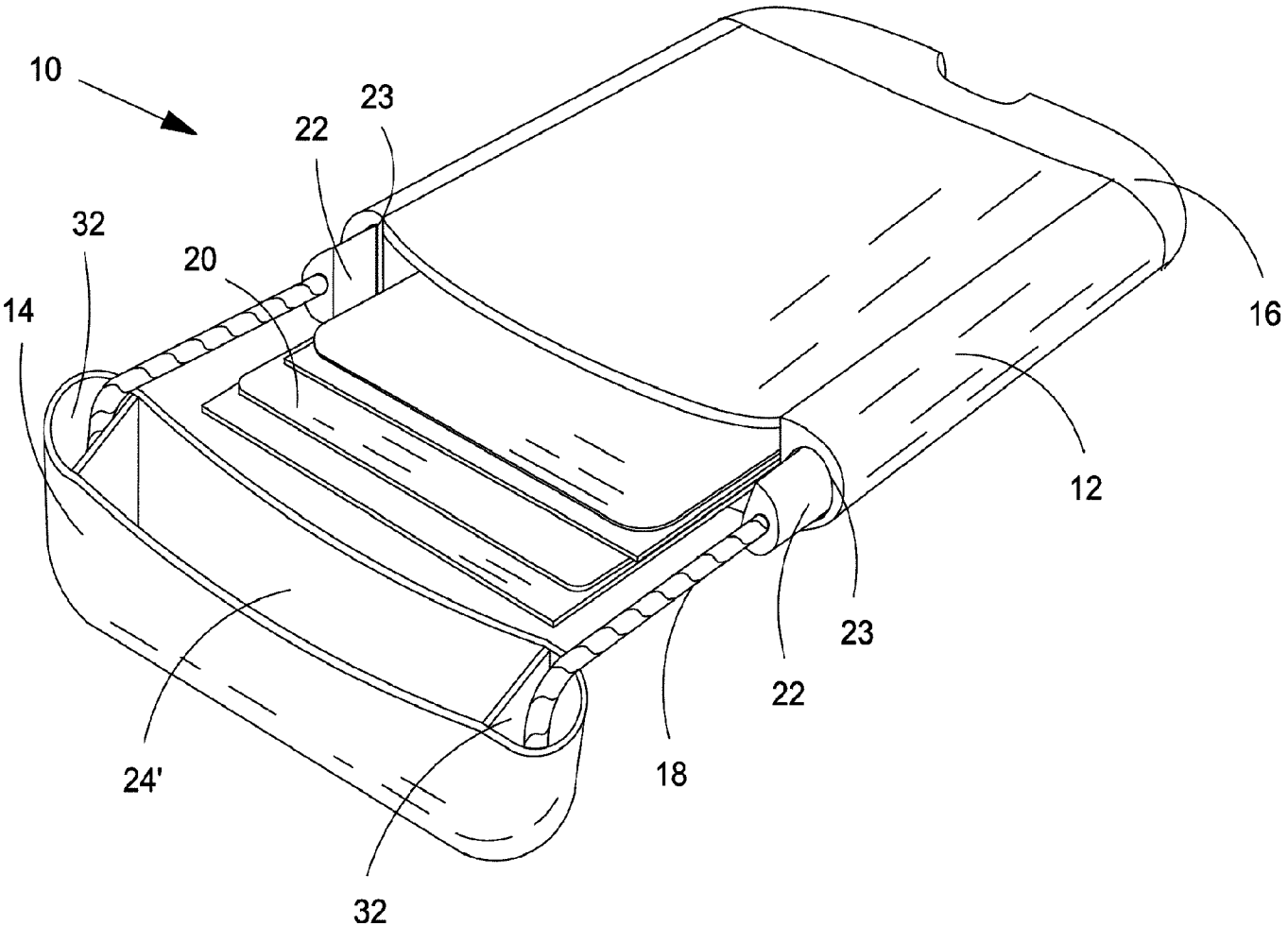
FIG. 4 is a view similar to that of FIG. 3, but with end cap 14 rotated 90° to illustrate the interior compartments of end cap 14.
Figure 4A:
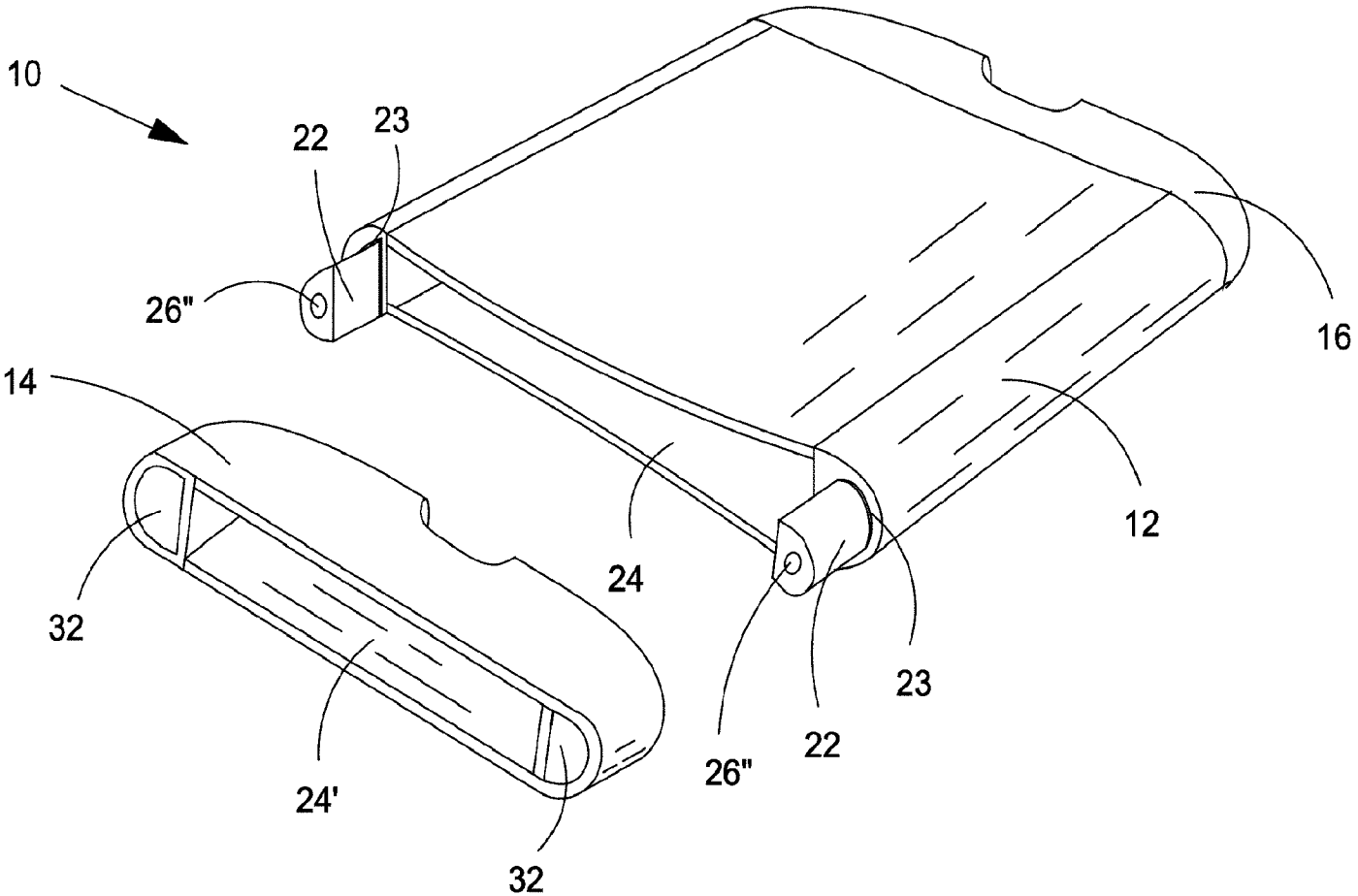
FIG. 4A is a perspective view of the case shown in FIG. 1, but with band 18 removed, and end cap 14 rotated 180°.

In FIG. 4 it is seen that second end cap 14 has been pulled leftwardly against the bias of elastic cord 18 and rotated 90° downwardly to expose inner space 24' and alignment receptacles 32. Alignment receptacles 32 are operatively arranged for accepting studs 22 therein and are disposed on either side of inner space 24'. As can be seen more clearly in FIG. 4*a*, which illustrates elastic cord 18 and second end cap 14 removed from the case and rotated 180°, alignment receptacles 32 and alignment studs 22 are complementary to one another such that second end cap 14 may be aligned and held in biased contact with housing 12 when the case is not in use. Alignment receptacles 32 while serving to align and secure the second end cap 14 to the housing are also provided for passing elastic cord 18 from channels 26" of the alignment studs 22 to channel 26' of the second end cap. Because articles 20 are held within the inner space of the holder and the first and second end caps, it is seen that damage thereto is avoided.

Figure 5:
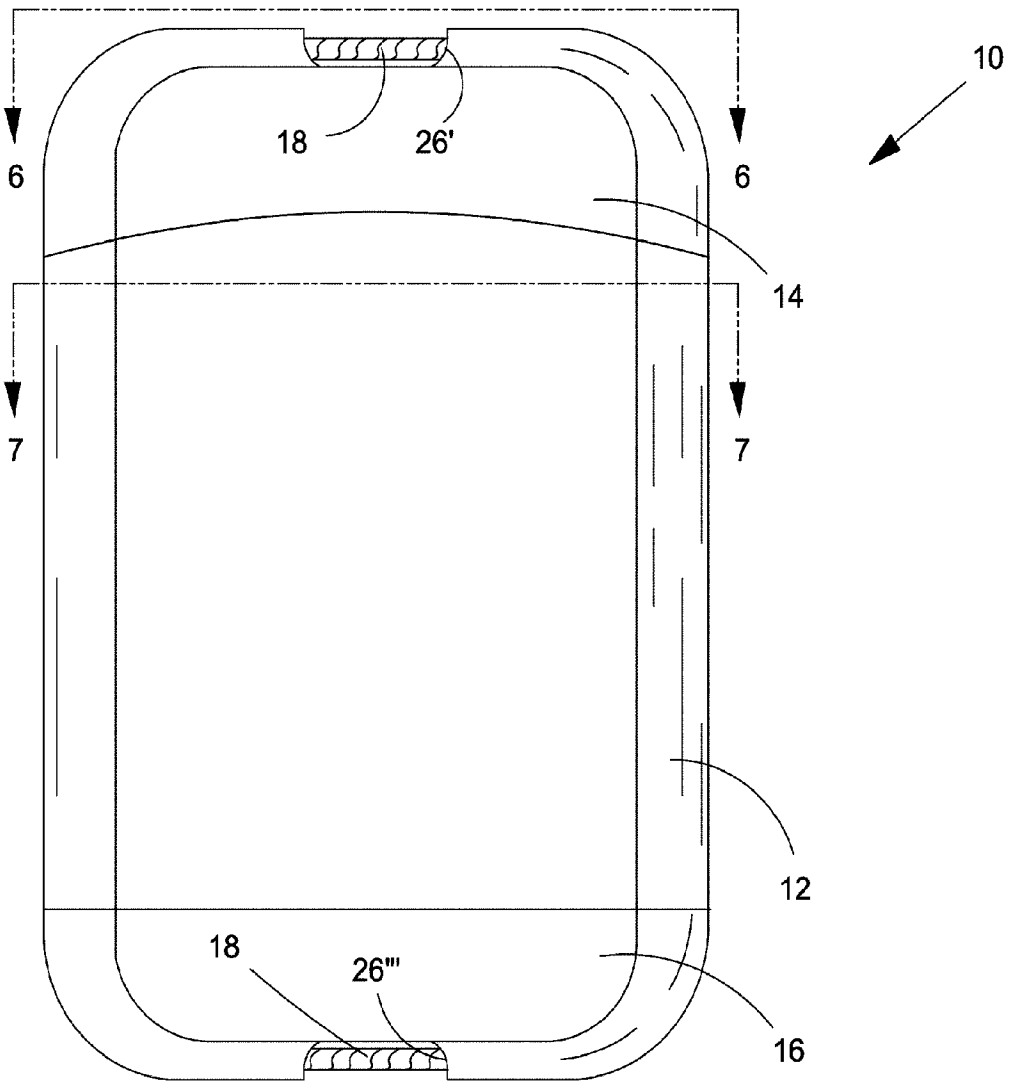
FIG. 5 is a top view of the case of the invention shown in FIG. 1, rotated such that end cap 14 is at the top of the drawing.
Figure 6:
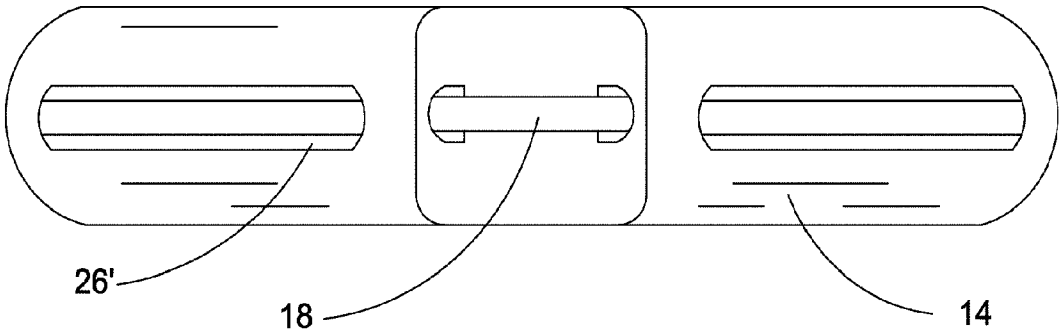
FIG. 6 is an end view of the case of the invention, taken generally along line 6—6 in FIG. 5.
Figure 7:
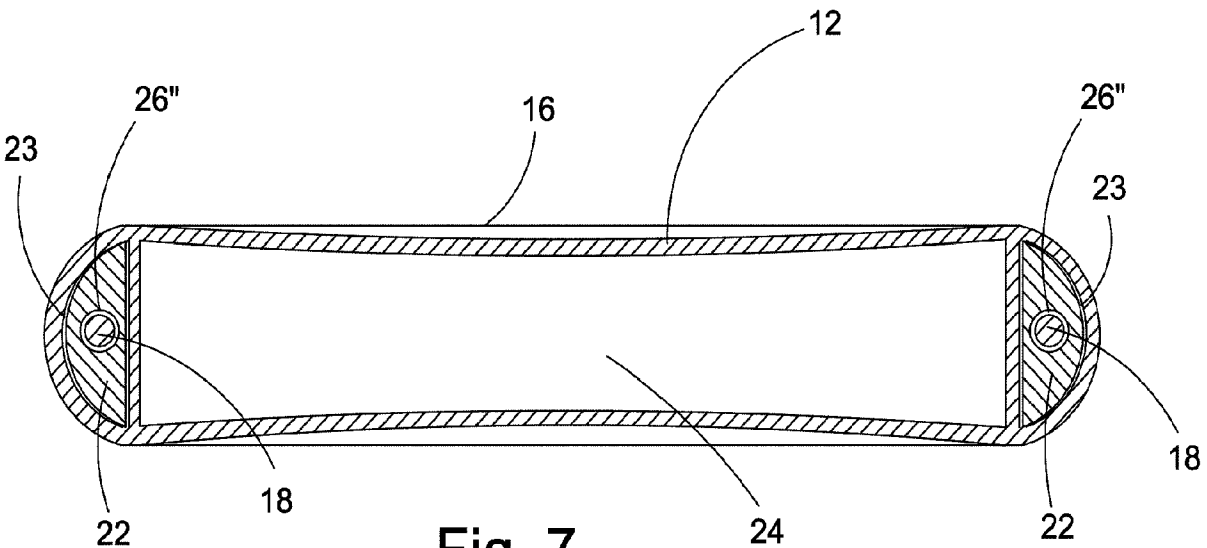
FIG. 7 is a cross sectional view of the case, taken generally along line 7—7 in FIG. 5.

In FIGS. 5 and 6, which illustrate a top view of the case and a view of the case taken generally along line 6—6 of FIG. 5, it is seen that second end cap 14 comprises channel 26' for passing elastic cord 18 therethrough such that the second end cap may be urged against the housing. As shown in FIG. 7, which is a view of the case taken generally along line 7—7 of FIG. 5, it is seen that elastic cord 18 is passed along the sides of the case by means of channels 26" extending along studs 22. It should be appreciated by those having ordinary skill in the art that while FIGS. 3A and 7 illustrate studs 22 as extending along the entire length of through-bores 23, studs 22 may be configured to comprise four studs secured at the terminal ends of through-bores 23 such that elastic cord 18 is passed through the studs and then through through-bores 23.

Figure 8:
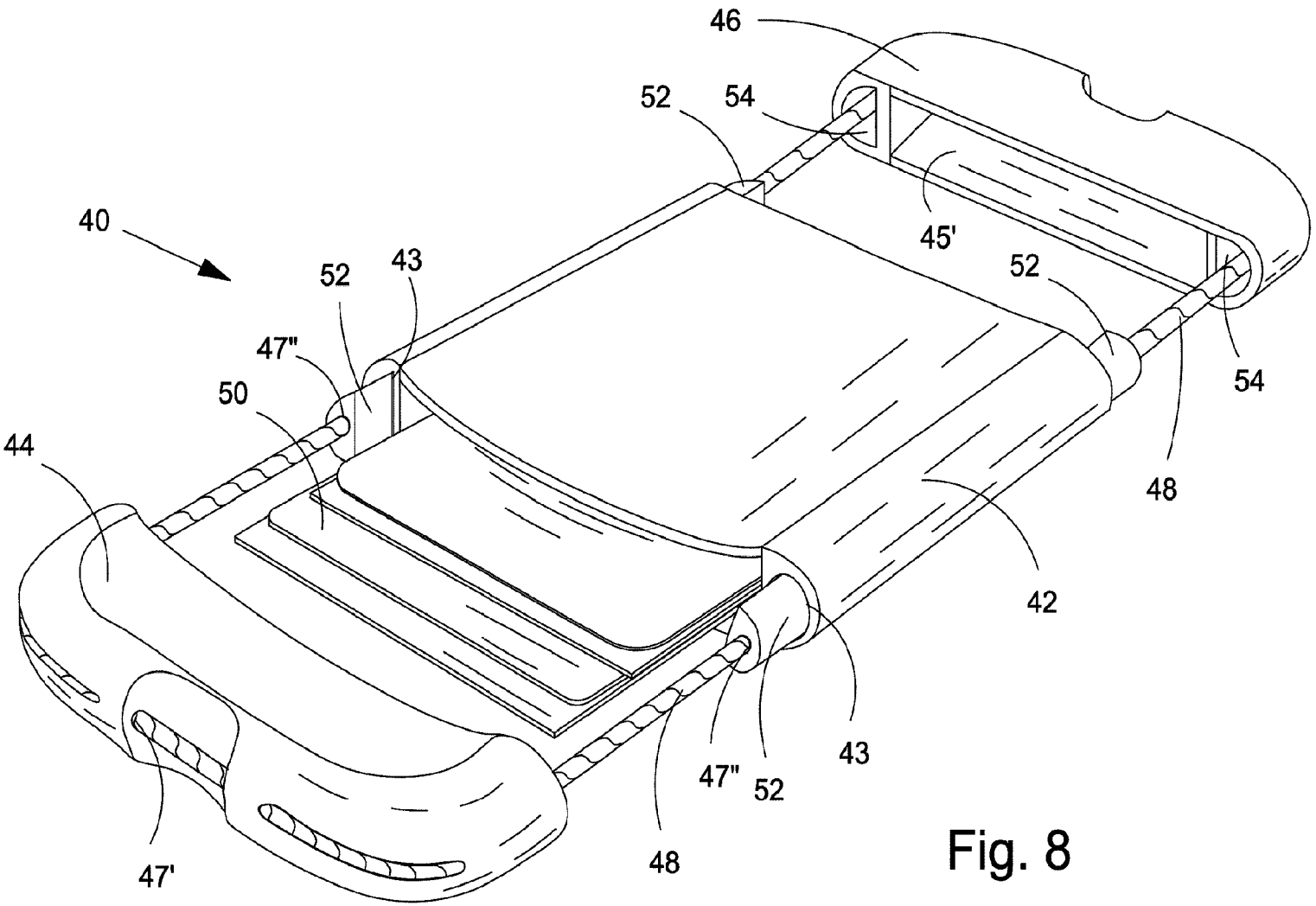
FIG. 8 is a perspective view of a second embodiment of the invention, shown with the case in an open position.
Figure 8A:
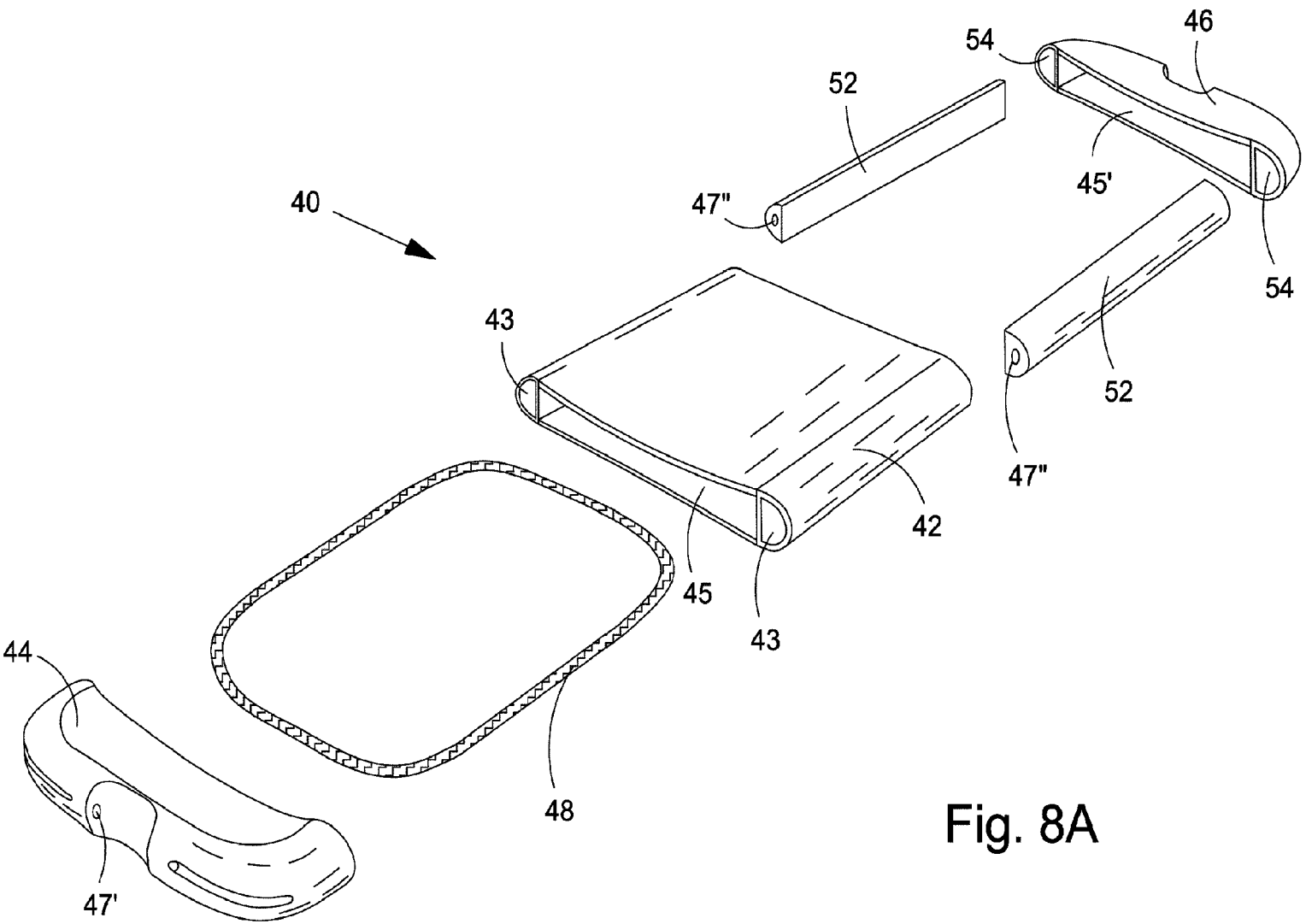
FIG. 8A is an exploded view of the case shown in FIG. 8.

While a preferred embodiment comprises detachable second end cap 14 and fixedly secured end cap 16, FIGS. 8–8A illustrate second embodiment 40 of the present invention, which embodiment comprises second end cap 44 and first end cap 46, each adapted to be detachably secured to housing 42 such that articles 50 may be held in inner space 45 and accessed from either end of the case. In this embodiment, it is seen that housing 42 comprises through-bores 43 for accepting studs 52 therein. Similar to the preferred embodiment described above, studs 52 each comprise channels 47" for passing elastic cord 48 therethrough and along the sides of the housing. Second end cap 44 and first end cap 46 are identical to one another and each comprise alignment receptacles 54 disposed on either side of inner space 45'. Alignment receptacles 54 each comprise a size and shape that is complementary to studs 52 such that the end caps 44 and 46 may be aligned and properly secured upon the housing. End caps 44 and 46 also each comprise a channel 47' for passing elastic cord 48 therethrough. Hence, when the elastic cord is arranged with in the channels of the studs and the end caps about the perimeter of the case, the two end caps may be secured to the housing via the bias provided by the elastic cord.

Figure 9:
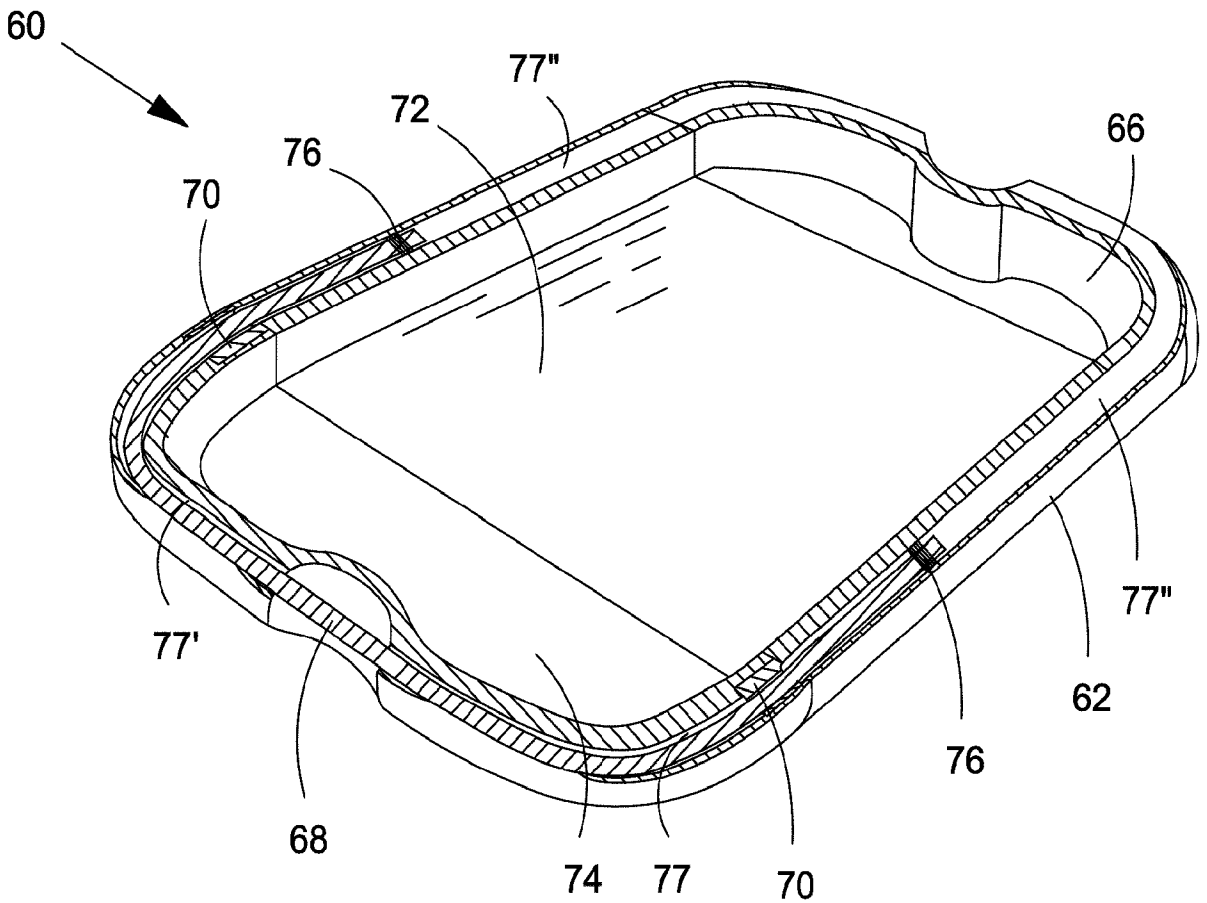
FIG. 9 is a cross-sectional view of a third embodiment of the invention (which third embodiment is not shown in perspective view), similar to the view shown in FIG. 2, in which third embodiment, band 18 has been replaced by band 68.
Figure 10:
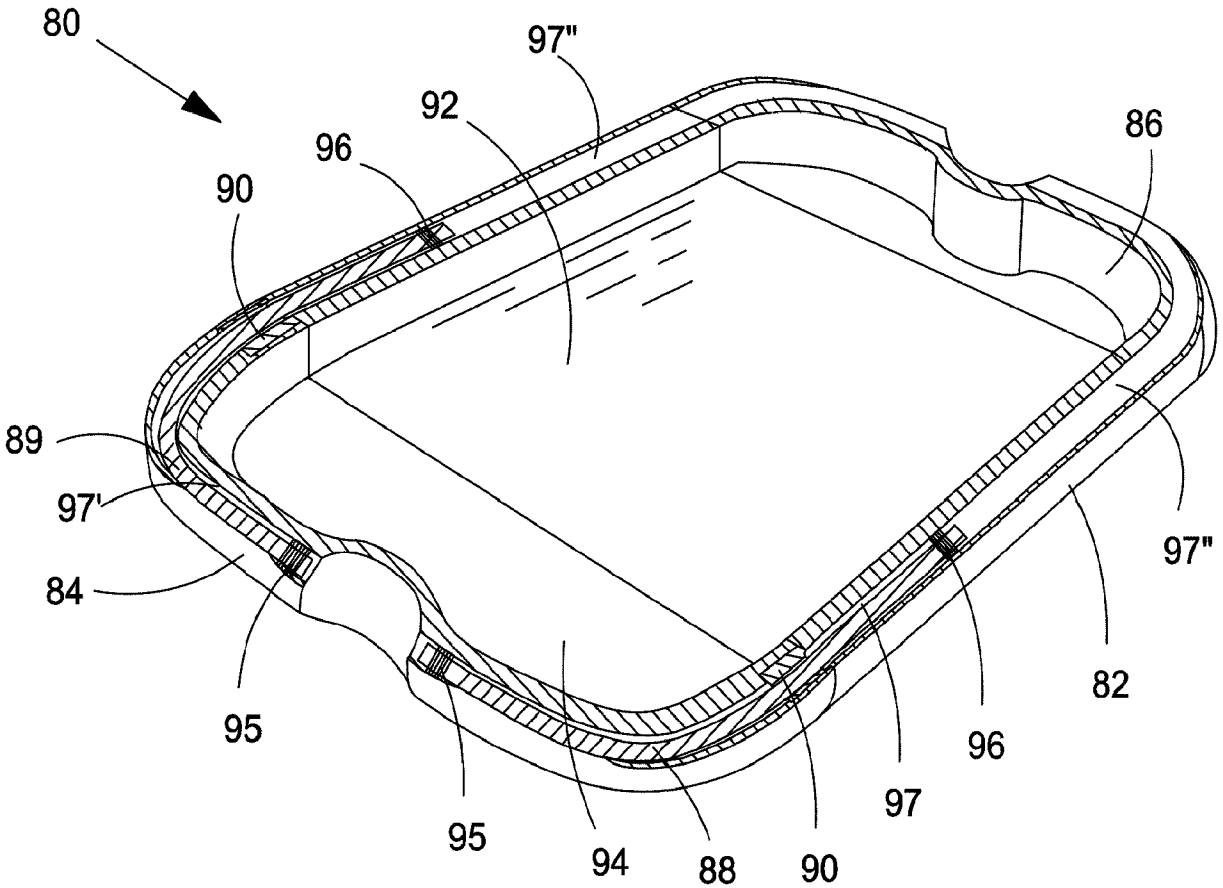
FIG. 10 is a cross-sectional view of a fourth embodiment of the invention (which fourth embodiment is not shown in perspective view), similar to the view shown in FIGS. 2 and 9, but with bands 18 and 68, replaced by two separate bands 88 and 89; and, FIG. 11 is a perspective view of a fifth embodiment of the invention, in this embodiment, the elastic band is located substantially outside the perimeter of the case.
Figure 11:
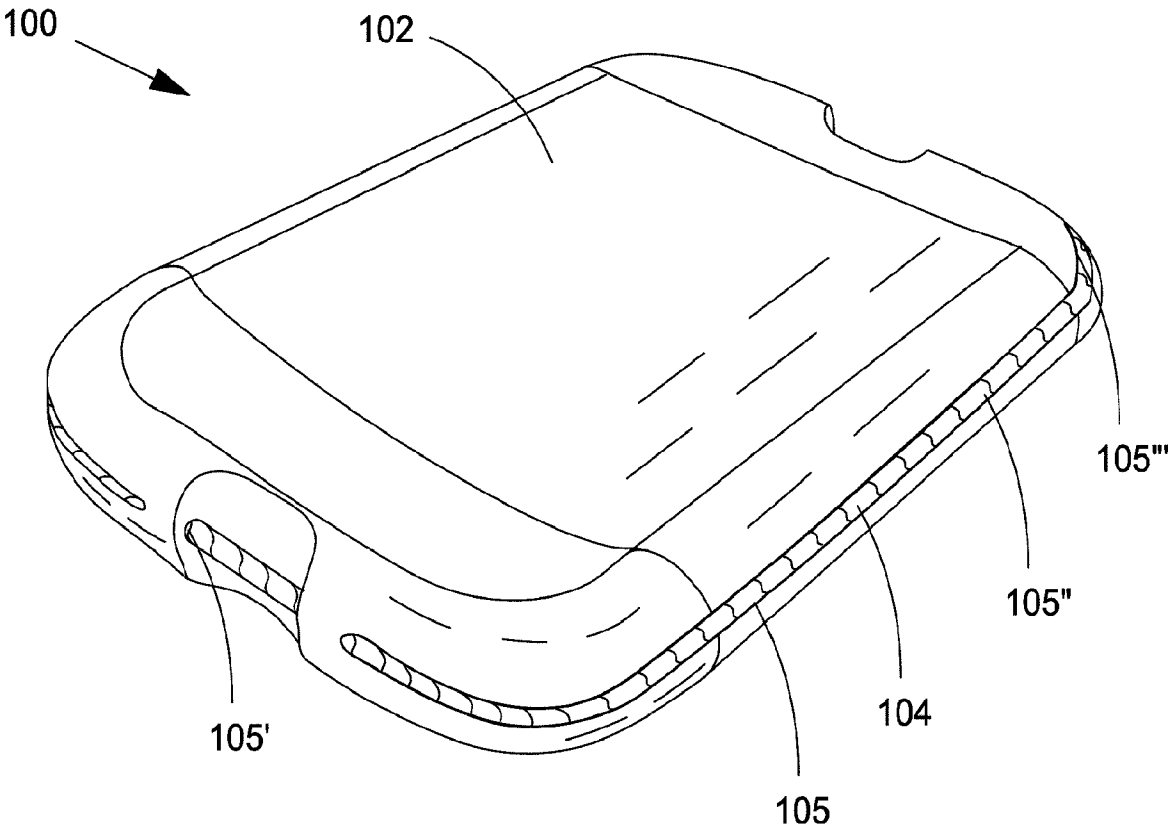

Finally, other embodiments of the case of the present invention are illustrated in FIG. 9–11. In FIG. 9, which illustrates a cross section of third embodiment 60, it is seen that the case could be configured to comprise a single linear elastic band arranged within channel 77. In this embodiment channel 77 comprises second end cap channel 77' and housing 72 comprises channels 77". Since first end cap 66 is adapted to be fixedly secured to housing 72, it may or may not comprise a channel for passing an elastic cord therethrough. Second end cap 74 is adapted to be detachably secured to housing 72. Housing 72 is adapted to comprise a pair of bores disposed on the sides of the housing for accepting alignment studs 70 therein. Alignment studs 70 each comprise a bore for passing and securing terminal ends 76 of the elastic band. The terminal ends of the elastic band may be secured within channel 77" for within the bore of studs 70 by virtually any appropriate means including, but not limited to: adhesives, staples, knots, etc. In FIG. 9 it is also seen that alignment studs 70 are provided for aligning second end cap 74 upon the housing such that elastic band 68 may be passed from the housing to the second end cap. It should be appreciated by those having ordinary skill in the art that alignment studs 70 may extend along the entire length of the bores on the sides of housing 72 or may be configured to extend only along a portion of the length of the bores.

In FIG. 10, which is a cross section of fourth embodiment 80, it is seen that the case could be configured to comprise a pair of linear elastic bands 88 and 89 disposed within channel 98. In this embodiment first end cap 86 is fixedly secured to housing 92 and second end cap 94 is adapted to be detachably secured to the housing. More specifically, second end cap 94 is detachably secured to the housing via linear elastic bands 88 and 89. Linear elastic bands 88 and 89 each comprise a pair of terminal 95 and 96. Terminal ends 95 are secured within channel 97' of second end cap 94 and terminal ends 96 are secured within channel 97" of housing 92. The terminal ends of the bands may be secured within channel 97" or the bores of studs 90 by virtually any appropriate means available in the art, e.g., adhesives, staples, knots, etc. In FIG. 10 it is also seen that housing 92 is adapted for securing studs 90, which align and secure second end cap 94 upon the housing such that the elastic bands 88 and 89 are passed from channel 97" to channels 97'.

In FIG. 11, which is a perspective view of fifth embodiment 100, it is seen that the case may be configured for securing closed loop elastic band 104 within channel 105 about the outer perimeter of the case. In this embodiment, channel 105 comprises second end cap channel 105', holder channels 105", which are formed within the sides of holder 102, and channel 105'", which is formed within the first end cap. Also, it should be appreciated that in this embodiment one of the first or second end caps may be detachable and the other fixed, or both configured to be detachable.

Thus, it is seen that the objects of the invention are efficiently obtained, although modifications and changes to the invention may be readily imagined by those having ordinary skill in the art, and these changes and modifications are intended to be within the scope of the claims.

What is claimed is:

1. A case, comprising:

a housing having a hollow interior and a respective channel extending along an outer perimeter of two longitudinal sides of said housing;

a first end cap secured to a first end of said housing, said first end cap having a channel extending along an outer perimeter thereof;

a second end cap secured to a second end of said housing, said second end cap having a channel extending along an outer perimeter thereof; and, at least one elastic band positioned within said channels of said housing said channel of said first end cap and said channel of said second end cap, said at least one elastic band operatively arranged to dispose said second end cap into a retained position in engagement with said second end of said housing.

2. The case as recited in claim 1 further comprising at least two studs disposed within said channels of said housing; said studs adapted for passing said at least one elastic band therethrough.

3. The case as recited in claim 2 wherein said second end cap further comprises at least two alignment receptacles; said alignment receptacles having a shape complementary to said studs and operatively arranged for mating therewith.

4. The case as recited in claim 3 wherein said at least one elastic band forms a closed loop.

5. The case as recited in claim 2 wherein said studs are adapted for securing a terminal end of said at least one elastic band.

6. The case as recited in claim 5 wherein said second end cap further comprises at least two alignment receptacles; said alignment receptacles having a shape complementary to said studs and operatively arranged for mating therewith.

7. The case as recited in claim 1 further comprising at least two studs disposed within said channels of said housing; said studs adapted for passing said at least one elastic band therethrough.

8. The case as recited in claim 7 wherein said first and second end caps each comprise at least two alignment receptacles; said alignment receptacles having a shape complementary to said studs and operatively arranged for mating therewith to secure said first and second end caps to said housing.

9. The case as recited in claim 8 wherein said at least one elastic band forms a closed loop.

10. The case as recited in claim 1 comprising first and second linear elastic bands; said first linear elastic band operatively arranged to urge said first end cap against a first end of said holder and said second linear elastic band operatively arranged to urge said second end cap against a second end of said holder.

11. The case as recited in claim 1 comprising a pair of linear elastic bands.

12. The case as recited in claim 11 further comprising at least two studs disposed within said channels of said housing; said studs adapted for securing a first free end of each of said pair of elastic bands.

13. The case as recited in claim 12 wherein said second end cap further comprises at least two alignment receptacles; said alignment receptacles having a shape complementary to said studs and operatively arranged for mating therewith; said second end cap adapted for securing a second free end of each of said pair of linear elastic bands.

14. The case as recited in claim 1 wherein said at least one elastic band is operatively arranged to dispose said second end cap into a retained position in engagement with said second end of said housing.

15. The case as recited in claim 1 wherein said at least one elastic band is operatively arranged to dispose said first end cap into a retained position in engagement with said first end of said housing.

16. The case as recited in claim 1 wherein said first end cap is fixedly secured to a first end of said housing.

17. The case as recited in claim 1 wherein said first end cap is fixedly secured to said first end of said housing and said second end cap is releasably secured to said second end of said housing.

18. The case as recited in claim 17 further comprising at least two studs, said studs disposed within said channels of said housing and adapted for passing said at least one elastic band therethrough; said second end cap further comprising at least two alignment receptacles; said alignment receptacles having a shape complementary to said studs such that said studs mate with said receptacles.

19. The case as recited in claim 18 wherein said at least one elastic band forms a closed loop.

20. A case, comprising:

a housing having a hollow interior and a respective channel extending along an outer perimeter of two longitudinal sides of said housing;

a first end cap securable to a first end of said housing, said first end cap having a channel extending along an outer perimeter thereof, a second end cap securable to a second end of said housing, said second end cap having a channel extending along an outer perimeter thereof; and, at least one elastic band positioned within said channels of said channel of said first end cap said housing and said channel of said second end cap, wherein said first end cap is fixedly secured to said first end of said housing and said at least one elastic band is operatively is arranged to releasably secure said second end cap in mating engagement with said second end of said housing.

* * * * *